US006202603B1

(12) United States Patent
Etemad

(10) Patent No.: US 6,202,603 B1
(45) Date of Patent: Mar. 20, 2001

(54) INTERNAL COMBUSTION ENGINE

(75) Inventor: Sassan Etemad, Västra Frölunda (SE)

(73) Assignee: AB Volvo, Gothenburg (SE)

( * ) Notice: Subject to any disclaimer, the term of this patent is extended or adjusted under 35 U.S.C. 154(b) by 0 days.

(21) Appl. No.: 09/424,762

(22) PCT Filed: May 27, 1998

(86) PCT No.: PCT/SE98/01003

§ 371 Date: Nov. 30, 1999

§ 102(e) Date: Nov. 30, 1999

(87) PCT Pub. No.: WO98/54455

PCT Pub. Date: Dec. 3, 1998

(30) Foreign Application Priority Data

May 30, 1997 (SE) ..... 9702055

(51) Int. Cl.[7] ..... F02F 1/36

(52) U.S. Cl. ..... 123/41.74; 123/41.31; 123/41.82 R

(58) Field of Search ..... 123/41.28, 41.29, 123/41.31, 41.41, 41.72, 41.74, 41.77, 41.82 R

(56) References Cited

U.S. PATENT DOCUMENTS

| | | | | |
|---|---|---|---|---|
| 4,590,894 | | 5/1986 | Ishida et al. | 123/41.74 |
| 5,357,910 | * | 10/1994 | Wenger et al. | 123/41.74 |
| 5,386,805 | * | 2/1995 | Abe et al. | 123/41.28 |
| 5,558,048 | | 9/1996 | Suzuki et al. | 123/41.24 |
| 5,868,106 | * | 2/1999 | Poropatic et al. | 123/41.82 R |
| 5,937,802 | * | 8/1999 | Bethel et al. | 123/41.74 |

FOREIGN PATENT DOCUMENTS

| | | |
|---|---|---|
| 0 208 461 | 1/1987 | (EP) . |
| 0 512 600 | 11/1992 | (EP) . |
| 0 550 422 | 7/1993 | (EP) . |

* cited by examiner

*Primary Examiner*—Willis R. Wolfe
*Assistant Examiner*—Hai Huynh
(74) *Attorney, Agent, or Firm*—Young & Thompson

(57) ABSTRACT

An internal combustion engine comprising a cylinder block (1) with at least two cylinders (8) and at least two exhaust valves (12) per cylinder (8), a slit (28) in the cylinder block (1) between each pair of cylinders (8), and a cooling system which comprises an inlet opening (36) for cooling liquid (20), formed in the cylinder block (1), an outlet opening (42) for cooling liquid (20), formed in a cylinder head (2), a restriction member (34) which is arranged in the cylinder block (1) and guides most of the cooling water flow to an intake side (38) of the cylinder block (1), and cooling liquid channels **(18*a*–18*e*) in the cylinder head (2) which are chiefly located on an exhaust side (40) of the cylinder head (2). The cooling liquid channels (18*a*–18*e*) open into the cylinder head (2) in an area between the exhaust valve seats (16) for each cylinder (8) and thereby regulate at the same time the flow and cooling around the cylinder liners (32) and between the exhaust valve seats (16)**.

8 Claims, 4 Drawing Sheets

INTERNAL COMBUSTION ENGINE

The present invention relates to an internal combustion engine comprising a cylinder block with at least two cylinders and at least two exhaust valves per cylinder, a slit in the cylinder block between each pair of cylinders, and a cooling system which comprises an inlet opening for cooling liquid, formed in the cylinder block, an outlet opening for cooling liquid, formed in a cylinder head, a restriction member which is arranged in the cylinder block and guides most of the cooling water flow to an intake side of the cylinder block, and cooling liquid channels in the cylinder head which are chiefly located on an exhaust side of the cylinder head.

An internal combustion engine having such a cooling system has already been disclosed in U.S. Pat. No. 5,558,048. The cooling liquid is conveyed into the cylinder block and is led to the intake side of the cylinder block by means of a restriction member. The cooling liquid passes the cylinders in the cylinder block and onwards to the cylinder head via an opening. However, the cooling liquid is also allowed to flow through slits which are formed between each cylinder. Each slit communicates with a cooling liquid channel which opens out between each cylinder in the cylinder head.

In internal combustion engines with cooling systems of this type, there is often inadequate cooling of the area between the exhaust valve seats for each cylinder in the cylinder head, since the geometry of the cylinder head is often configured so that the velocity of flow of the cooling liquid is low at the area between the exhaust valve seats.

One object of the present invention is to provide satisfactory cooling of the area between the exhaust valve seats in the cylinder head of an internal combustion engine.

Another object of the present invention is to make available a locally controlled cooling of the area between the exhaust valve seats of an internal combustion engine.

Yet another object of the present invention is to provide a satisfactory cooling liquid flow through the slits between each pair of cylinders in order thereby to create a satisfactory and uniform cooling of cylinders and cylinder liners and thereby counteract deformation of cylinder and liner.

According to the invention, these and further objects are achieved by the fact that the cooling liquid channels open into the cylinder head in an area between the exhaust valve seats for each cylinder.

An internal combustion engine having such a cooling system creates a satisfactory and uniform cooling of the cylinders and the cylinder liners, and at the same time a satisfactory cooling of the cylinder head in the region between the exhaust valve seats is obtained, which among other things makes it easier to achieve stoichiometric combustion at high load.

Figure 1:
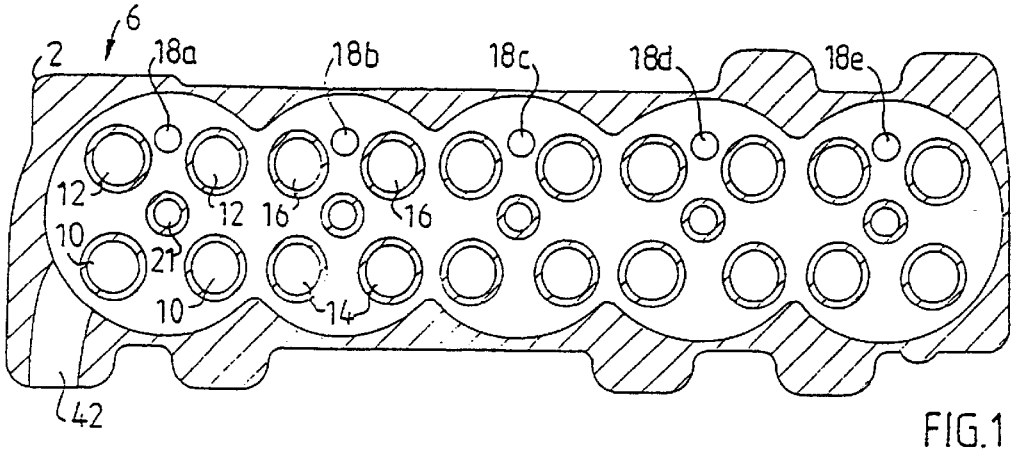
Figure 2:
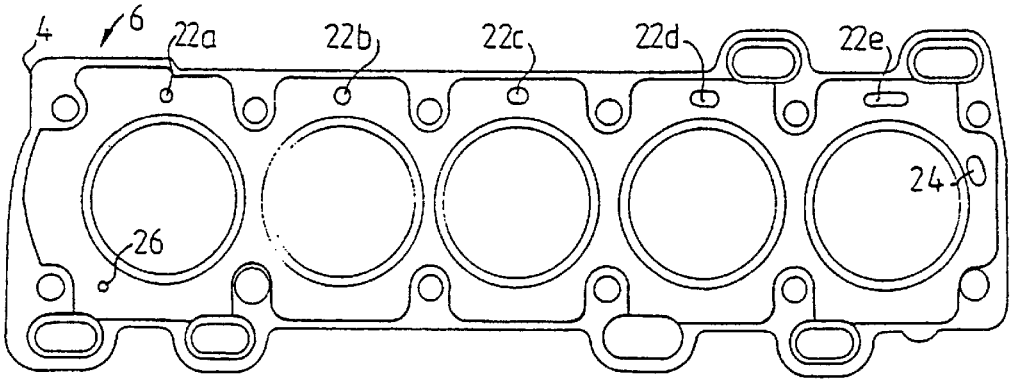
Figure 3:
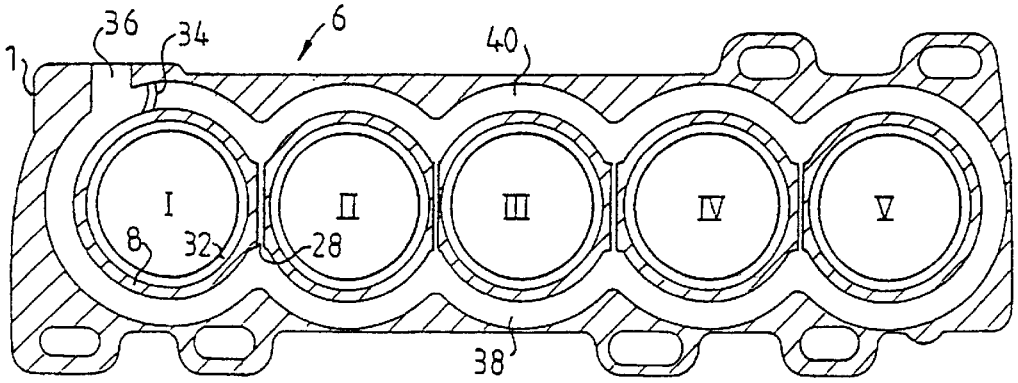
Figure 4:
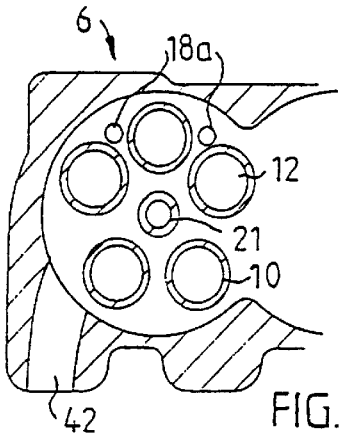
Figure 6:
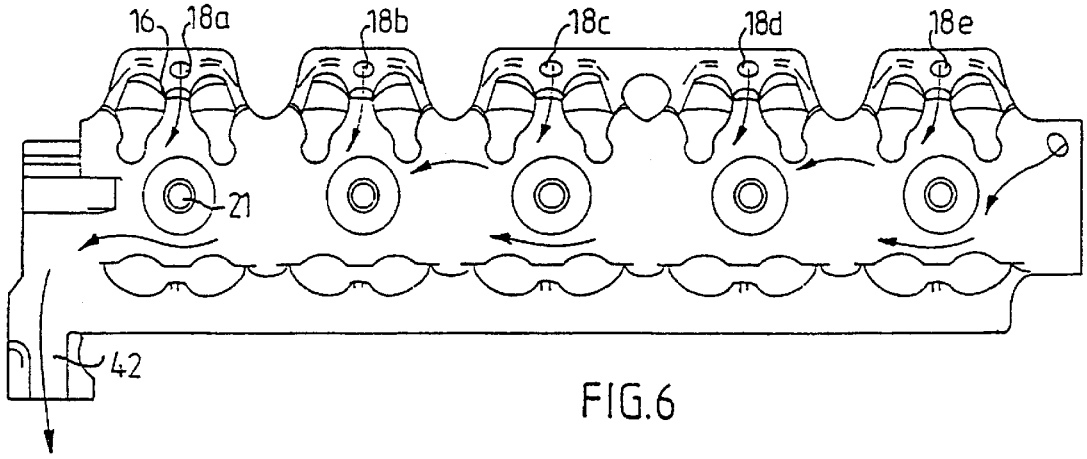
Figure 5:
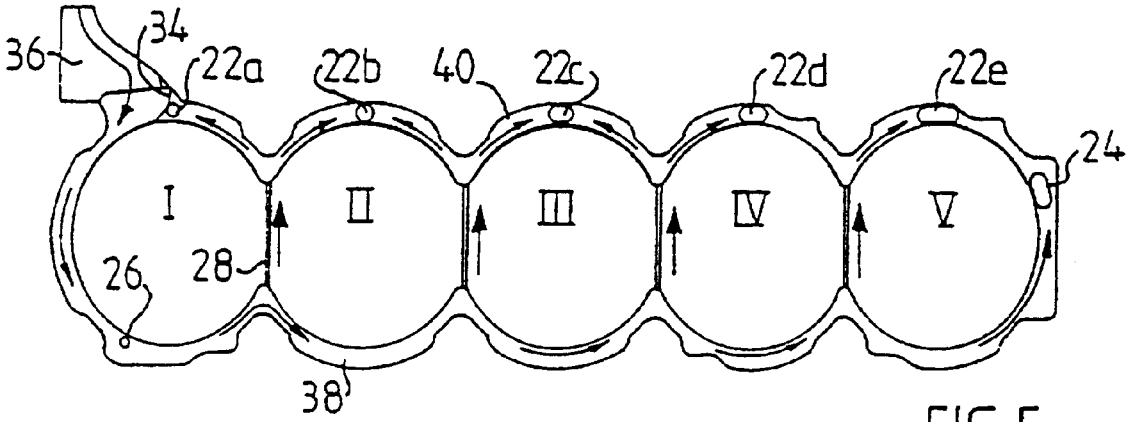
Figure 7:
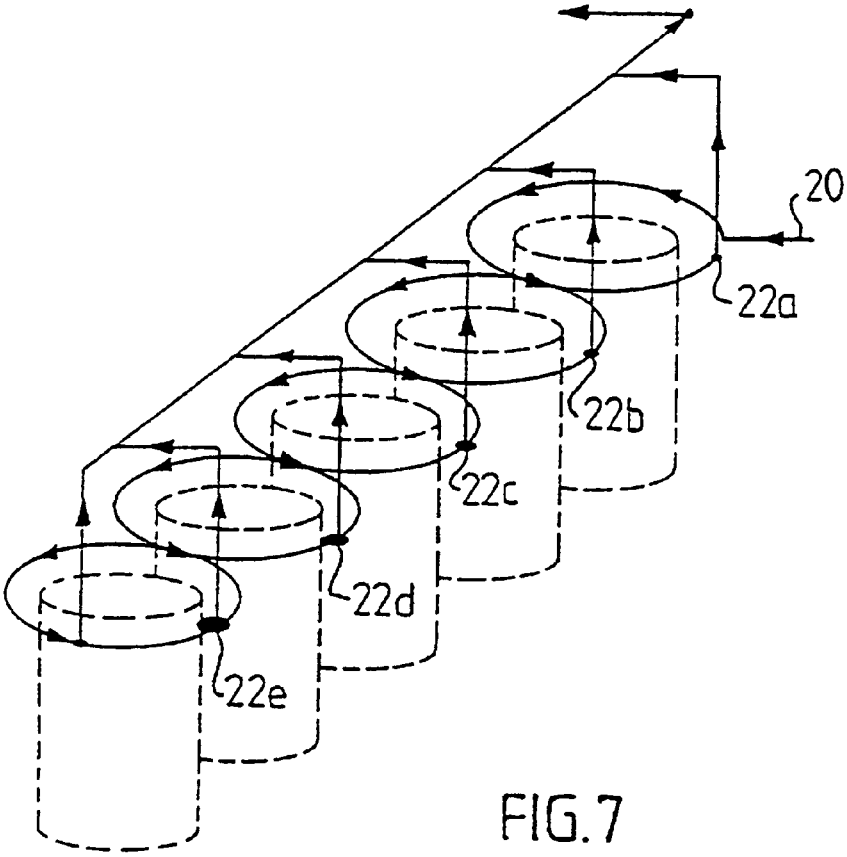
Figure 8:
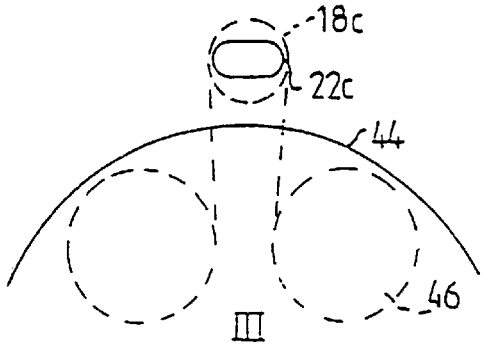
Figure 9:
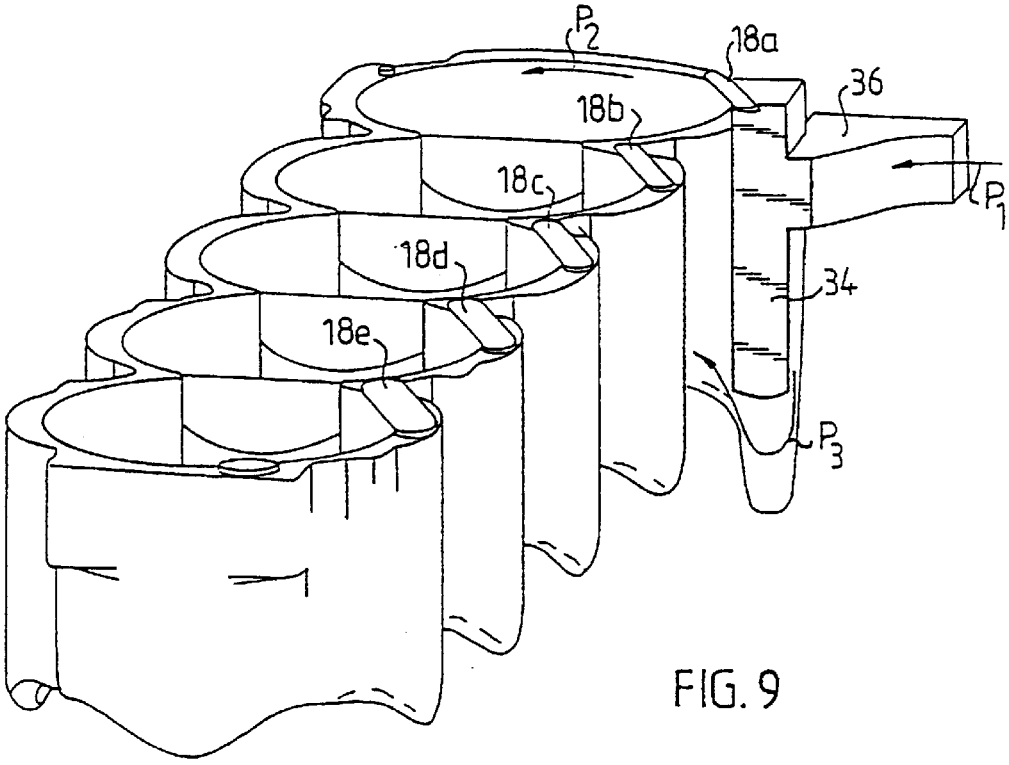

The invention will be described in greater detail below with reference to illustrative embodiments which are shown in the attached drawings, where:

FIG. 1 shows a cylinder head according to a first embodiment of the present invention, FIG. 2 shows a cylinder head gasket according to a first embodiment of the present invention, FIG. 3 shows a cylinder block according to a first embodiment of the present invention, FIG. 4 shows a partial view of a cylinder head according to a second embodiment of the present invention, FIG. 5 shows a diagrammatic outline of how cooling liquid flows in an internal combustion engine according to the first embodiment of the present invention, FIG. 6 shows a diagrammatic outline of how cooling liquid flows in an internal combustion engine according to the first embodiment of the present invention, FIG. 7 shows a diagrammatic outline in perspective of how cooling liquid flows in an internal combustion engine according to the first embodiment of the present invention, FIG. 8 shows a partial view of how a hole in a cylinder head gasket cooperates with a cooling liquid channel in a cylinder head according to the first embodiment, and FIG. 9 shows a diagrammatic perspective view of the distribution of the cooling liquid in the cylinder block of an internal combustion engine according to the first embodiment of the present invention.

FIGS. 1–3 show a cylinder block 1 with associated cylinder head 2 and cylinder head gasket 4 for forming an internal combustion engine 6. The internal combustion engine 6 according to the illustrative embodiment shown is designed with five cylinders 8 in a row. The cylinders 8 are numbered one to five (I–V), where cylinder number one (I) is situated furthest to the left and cylinder number five (V) is situated furthest to the right in FIG. 3. Each cylinder 8 is provided with two inlet valves 10 and two exhaust valves 12 which cooperate with respective valve seats 14, 16 in the cylinder head 2. A cooling liquid channel 18*a*–18*e* opens out between the exhaust valve seats 16 for each cylinder 8. The cooling liquid channels 18*a*–18*e* create a flow communication for cooling liquid 20 between the cylinder block 1 and the cylinder head 2. According to the illustrated embodiment in FIG. 1, the cooling liquid channels 18*a*–18*e* have the same cross-sectional area relative to one another. In the embodiment shown, a central hole 21 is also formed in each cylinder 8, which hole is intended for an ignition pin (not shown).

Arranged between the cylinder block 1 and the cylinder head 2 there is a cylinder head gasket 4 which is provided with a number of holes 22*a*–22*e* intended to cooperate with the cooling liquid channels 18*a*–18*e* in the cylinder head 2. The holes 22*a*–22*e* have different cross-sections for the purpose of creating a locally controlled cooling liquid flow in the respective channel 18*a*–18*e* and thus for obtaining essentially the same volume flow through all the channels 18*a*–18*e*. This is described in more detail below. A further hole 24 for cooling water is arranged in the gasket 4 of cylinder number five (V) in order to allow the cooling liquid 20 to flow round cylinder number five (V) and thereby create a uniform flow of cooling liquid around this cylinder (V). At cylinder number one (I) there is also a hole 26 in the gasket, which hole 26 ensures that any air bubbles in the cooling liquid 20 are led off from the cylinder block 1.

FIG. 3 shows how slits 28 are formed in a partition wall 30 which is arranged between each adjoining cylinder 8. The width of the slits 28 is about 1 mm and they have a depth of about 20 mm. The purpose of the slits 28 is to relieve the cylinders 8, and cylinder liners 32 arranged in the cylinders 8, from stresses in the longitudinal direction of the internal combustion engine 6, which stresses derive from, among other things, heat development in the internal combustion engine 6. If the stresses become too great, the cylinders 8 and the liners 32 can become deformed and non-round, which leads among other things to increased friction between piston (not shown) and liner 32 and to increased oil consumption, which leads to increased emissions. The deformation of the cylinders 8 and the liners 32 also leads to gas leakage between piston and liner, so-called blow-by, and also to increased vibrations and loss of power. In order to reduce still further the thermal stresses in the cylinders 8 and liners 32, cooling liquid 20 is conveyed through the slits 28.

FIG. 3 also shows how a restriction member 34 is arranged in the cylinder block 1 close to an inlet opening 36 for the cooling liquid 20. The restriction member 34 can consist, for example, of a bent plate which is preferably shaped in such a way that it causes as small as possible a drop in pressure of the cooling liquid 20. The restriction member 34 can also consist of a unit cast into the cylinder block 1. The purpose of the restriction member 34 is to guide the principal cooling liquid flow to an intake side 38 of the cylinder block 1. Intake side 38 here signifies that side of the cylinders 8 on which the inlet valves 10 are located, and principal flow here signifies at least 75% of the flow. The restriction member will preferably guide at least 90% of the cooling liquid flow to the intake side 38 of the cylinder block 1.

FIG. 4 shows a second embodiment in which each cylinder 8 of an internal combustion engine 6 is provided with three exhaust valves 12 and two inlet valves 10. According to this embodiment, the cooling liquid channels 18*a* open out between respective pairs of exhaust valves 12 in the cylinder head 2.

FIG. 5 shows a diagrammatic outline of how cooling liquid 20 flows in an internal combustion engine 6 according to the invention. The cooling liquid 20 is led into the cylinder block 1 through the inlet opening 36 under pressure which is obtained by means of a cooling liquid pump (not shown). Most of the cooling liquid flow is thereafter guided by the restriction member 34 in the direction towards the intake side 38 of the engine 6. The cooling liquid channels 18*a*–18*e* which lead the cooling liquid 20 to the cylinder head 2 are chiefly located on an exhaust side 40 of the cylinder block 1, which means that the pressure of the cooling liquid 20 is lower on the exhaust side 40 and higher on the intake side 38. Exhaust side 40 here signifies that side of the cylinders 8 on which the exhaust valves 12 are located. This leads to the cooling liquid 20 seeking to flow towards the exhaust side 40. Since the slits 28 extend from the intake side 38 to the exhaust side 40, the pressure difference of the cooling liquid 20 between intake side 38 and exhaust side 40 will cause cooling liquid 20 to flow in the slits 28 in the direction towards the exhaust side 40. The pressure on the intake side 38 drops successively in the direction towards cylinder number five (V). To obtain essentially the same volume flow in all the slits 28, the holes 22*a*–22*e* which are formed in the cylinder head gasket 4, and which cooperate with the cooling liquid channels 18*a*–18 *e* in the cylinder head 2, are formed with different cross-sections. The hole 22*a* nearest the inlet opening 36 for the cooling liquid 20 has the smallest cross-section. The hole cross-section then increases successively and is largest at cylinder number five (V). As is shown in FIG. 5, a further hole 24 is arranged on cylinder number five (V), which is described above. Instead of forming the holes 22*a*–22*e* in the cylinder head gasket 4 with different cross-sections, the cooling liquid channels 18*a*–18*e* can themselves be designed with different cross-sectional areas. The holes 22*a*–22*e* in the cylinder head gasket 4 can also have essentially the same cross-section and shape and the cross-section and shape of the cooling liquid channels 18*a*–18*e* in the area of the cylinder head which adjoins the cylinder head gasket 4.

FIG. 6 shows how cooling liquid 20 flows in the cylinder head 2. The cooling liquid channels 18*a*–18*e* open out in an area between the exhaust valve seats 16 for each cylinder 8 and the cooling liquid 20 leaves the cylinder head 2 by way of an outlet opening 42.

FIG. 7 is a diagrammatic outline in perspective showing how cooling liquid 20 flows in an internal combustion engine 6 according to the invention. After the cooling liquid 20 has passed the cooling liquid channels 18*a*–18*e* in the cylinder head 2, which open out in the area between the exhaust valve seats 16, the cooling liquid 20 flows towards an outlet opening 42 in the cylinder head 2.

FIG. 8 shows in detail how a hole 22*c* in the cylinder head gasket 4 cooperates with a cooling liquid channel 18*c* in the cylinder head 2. The hole 22*c* has a smaller cross-section than the cross-sectional area of the cooling liquid channel 18*c*, which means that a controlled volume flow of the cooling liquid 20 in the cooling liquid channel 18*c* is obtained. The full line 44 symbolizes the position of the cylinder 8, and the two circles 46 in broken lines symbolize the position of the exhaust valves 12.

FIG. 9 shows a diagrammatic perspective view of the distribution of the cooling liquid 20 in the cylinder block 1 of an internal combustion engine 6 according to the present invention. The arrow $P_1$ shows where the cooling liquid 20 enters the inlet opening 36 to the cylinder block 1. The principal cooling liquid flow is guided by the restriction member 34, which leads the cooling liquid 20 round cylinder number one (I), as is shown by the arrow $P_2$. The arrow $P_3$ shows that a smaller part of the cooling liquid flow passes under the restriction member 34. This is to ensure a satisfactory cooling of cylinder number one (I). The cooling liquid which flows in the cooling liquid channels 18*a*–18*e* is also shown in FIG. 9.

Instead of cooling liquid 20 entering through the inlet opening 36 in the cylinder block 1, it is possible for the cooling liquid 20 to be introduced through the outlet opening 42 in the cylinder head 2, so that a cooling liquid flow in the opposite direction is obtained.

The inlet and outlet openings 36, 42 for the cooling liquid 20 can also be placed at locations in the cylinder block 1 and cylinder head 2, respectively, other than those locations shown in the embodiment in the figures.

A five-cylinder in-line engine is shown in the embodiment according to the figures. However, the cooling system according to the invention can be applied in any internal combustion engine of the piston type, such as a V-engine. The said internal combustion engine can also be of the so-called open-deck type and closed-deck type, both with so-called wet liners and dry liners, and also of the monoblock type.

What is claimed is:

1. Internal combustion engine comprising a cylinder block (1) with at least two cylinders (8) and at least two exhaust valves (12) per cylinder (8), a slit (28) in the cylinder block (1) between each pair of cylinders (8) and a cooling system which comprises an inlet opening (36) for cooling liquid (20), formed in the cylinder block (1), an outlet opening (42) for cooling liquid (20), formed in a cylinder head (2), a restriction member (34) which is arranged in the cylinder block (1) and guides most of the cooling water flow to an intake side (38) of the cylinder block (1), and cooling liquid channels (18*a*–18*e*) in the cylinder head (2) which are chiefly located on an exhaust side (40) of the cylinder head (2), characterized in that the cooling liquid channels (18*a*–18*e*) open into the cylinder head (2) in an area between the exhaust valve seats (16) for each cylinder (8).

2. Internal combustion engine according to claim 1, characterized in that the inlet opening (36) for cooling liquid (20) in the cylinder block (1) and the outlet opening (42) for cooling liquid (8) in the cylinder head (2) are located at one and the same end of the internal combustion engine (6).

3. Internal combustion engine according to claim 1, characterized in that the inlet opening (36) for cooling liquid (20) in the cylinder block (1) and the outlet opening (42) for cooling liquid (8) in the cylinder head (2) are located at different ends of the internal combustion engine (6).

4. Internal combustion engine according to claim 1, characterized in that the cooling liquid channels (18*a*–18*e*) which open out between the exhaust valve seats (16) in the cylinder head (2) have essentially the same cross-sectional area relative to one another.

5. Internal combustion engine according to claim 1, where a cylinder head gasket (4) is arranged between the cylinder block (1) and the cylinder head (2), characterized in that the gasket (4) comprises a number of holes (22*a*–22*e*) with different cross-sectional areas, intended to cooperate with the cooling liquid channels (18*a*–18*e*) in the cylinder head (2).

6. Internal combustion engine according to claim 1, characterized in that the cooling liquid channels (18*a*–18*e*) in the cylinder head (2) have different cross-sectional areas relative to one another.

7. Internal combustion engine according to claim 1, characterized in that the restriction member (34) is designed in such a way that over 75% of the cooling liquid flow is guided by the retriction member (34) to the intake side (38) of the cylinder block (1).

8. Internal combustion engine according to claim 1, characterized in that the restriction member (34) is designed in such a way that over 90% of the cooling liquid flow is guided by the restriction member (34) to the intake side (38) of the cylinder block (1).

* * * * *